US011351683B2

(12) United States Patent
Wang

(10) Patent No.: US 11,351,683 B2
(45) Date of Patent: Jun. 7, 2022

(54) UTILITY KNIFE

(71) Applicant: Aiguo Wang, Xidian (CN)

(72) Inventor: Aiguo Wang, Xidian (CN)

( * ) Notice: Subject to any disclaimer, the term of this patent is extended or adjusted under 35 U.S.C. 154(b) by 43 days.

(21) Appl. No.: 17/247,592

(22) Filed: Dec. 17, 2020

(65) Prior Publication Data

US 2022/0063116 A1 Mar. 3, 2022

(30) Foreign Application Priority Data

Aug. 31, 2020 (CN) ..... 202010899277.8

(51) Int. Cl.
*B26B 5/00* (2006.01)
*B26B 1/08* (2006.01)
*B25G 1/08* (2006.01)

(52) U.S. Cl.
CPC ..... *B26B 5/003* (2013.01); *B25G 1/08* (2013.01); *B26B 1/08* (2013.01)

(58) Field of Classification Search
None
See application file for complete search history.

(56) References Cited

U.S. PATENT DOCUMENTS

| | | | | |
|---|---|---|---|---|
| 6,192,589 | B1 * | 2/2001 | Martone | B26B 5/001 30/162 |
| 7,316,070 | B2 * | 1/2008 | Green | B26B 5/003 30/162 |
| 8,595,942 | B2 * | 12/2013 | Ho | B26B 5/003 30/162 |
| 8,621,753 | B2 * | 1/2014 | Price | B26B 5/001 30/162 |
| 10,421,201 | B2 * | 9/2019 | Schmidt | B26B 5/003 |
| 2003/0196331 | A1 * | 10/2003 | Ho | B26B 5/001 30/162 |
| 2022/0063116 | A1 * | 3/2022 | Wang | B26B 5/001 |

* cited by examiner

*Primary Examiner* — Hwei-Siu G Payer
(74) *Attorney, Agent, or Firm* — Wang Law Firm, Inc.

(57) ABSTRACT

A utility knife comprises a housing (1), a blade carrier (2), a blade (3), a position control component (4) and a safety control component (5); a positioning direction (B) is defined at an angle to the sliding direction (A) of the position control component (4), the first blocking position (141) is farther away from the positioning portion (42) of the position control component (4) than the rest areas of the slide rail (13) except the first blocking position (14). In this way, in addition to blocking position shift, the position control component can also be used for contact-fitting with the blade carrier to determine whether the blade carrier can slide forward independently. Therefore, the utility knife has fewer components, resulting in low material cost, fewer assembly steps, convenient and time-saving assembly process, and the components are not easy to lose.

12 Claims, 11 Drawing Sheets

UTILITY KNIFE

TECHNICAL FIELD OF THE INVENTION

The present invention relates to the field of hand tools, in particular to a utility knife.

BACKGROUND OF THE INVENTION

The utility knife is a commonly used hand tool for cutting paper, leather, plastic sheets, cardboard, etc. The utility knife generally comprises a housing, a blade carrier, and a blade. The housing has an accommodating cavity and a front opening communicated with the accommodating cavity. The blade carrier is arranged in a sliding manner in the accommodating cavity of the housing, and the blade is arranged on the blade carrier and can go into and out of the front opening as the blade carrier slides.

In order to overcome the problem that the blade does not retract automatically after its extension, solutions have been proposed. For example, Chinese Invention Patent CN102398272B disclosed a geared safety knife. The geared safety knife comprises an outer frame, a blade carrier, a blade, a push button, a blocking position and a blocking position slider, etc. A control component is arranged on the blocking position slider, which is exposed out of the outer frame from a chute and can be positioned at the blocking position. An interlock structure is arranged between the blocking position slider and the blade carrier, and the blade carrier is connected to an elastic reset component that applies an elastic force on the blade carrier toward the outer frame. The interlock structure locks the blade carrier and the blocking position slider together when the blocking position slider is positioned, by the control component, at a position where the blade extends out of the outer frame. The interlock structure unlocks the blade carrier and the blocking position slider when the blocking position slider is positioned, by the control component, at a position where the blade is retracted in the outer frame. The blade carrier and the blocking position slider have overlapping portions in the front-to-rear direction. The interlock structure comprises a lock pin, a pin hole, a support surface and a retreat portion. The lock pin extends, by the support of the support surface, into the pin hole to lock the blade carrier and the blocking position slider together, when the blocking position slider is positioned at a blocking position where the blade extends out of the outer frame. The lock pin retreats into the retreat portion to exit the pin hole to unlock the blade carrier and the blocking position slider, when the blocking position slider is positioned at a blocking position where the blade retracts into the outer frame. Alternatively, the interlock structure comprises an elastic lock plate, a support surface and a retreat portion. The elastic lock plate is arranged on the blocking position slider. A lock hole and a lock tongue are arranged on the elastic lock plate and the blade carrier, respectively. The support surface and the retreat portion are abutted on the outer frame. The elastic lock plate is supported by the support surface so that the lock hole is sleeved on the lock tongue to lock the blade carrier and the blocking position slider together, when blocking position slider is positioned (by the control component) at a blocking position where the blade extends out of the outer frame. The elastic lock plate retreats into the retreat portion so that the lock hole separates from the lock tongue to unlock the blade carrier and the blocking position slider, when blocking position slider is positioned (by the control component) at a blocking position where the blade is retracted into the outer frame. Thus, this geared safety knife has a blocking position mode and a safety mode in which the blade can automatically retract into the outer frame.

However, this patent has the following problems. First, the interlock structure comprises a pin shaft, a pin hole, a retreat portion, a support surface, an elastic component arranged on the lock pin to apply an elastic force to the support surface and the retreat portion, or the interlock structure comprises an elastic lock plate, a lock tongue, a support surface and a retreat portion. Thus, the utility knife has many parts, resulting in high material cost, and many assembly steps and time-consuming assembly process.

Second, the pin shaft and the pin hole or the lock plate and the lock tongue are small in size, high assembly accuracy is required. In the case of any slight misalignment in position, the pin shaft and the pin hole, or the lock plate and the lock tongue, cannot be well interlocked, consequently the interlock structure is invalid. In addition, the pin shaft and the lock tongue of the interlock structure are easy to lose due to their small size.

Third, after the application of an external force to the control component (equivalent to the position control component below), that is, when the control component is just pressed into the housing without pushing the control component to slide forward, because the lock pin does not extend into the pin hole, the blade carrier and the blocking position slider cannot be interlocked immediately. At this time, if the utility knife is used abnormally or violently, the blade carrier can slide forward independently. Consequently, the blade on the blade carrier will be thrown out to hurt the user or other people. In particular, if the retreat portion comprises a slope that transitions to the support surface, in addition to the blade being thrown out when the control component is pressed into the housing, the blade will also be thrown out when the control component is at a position corresponding to the retreat portion (in this case, the control component may now have slid by a certain distance), comprising the case where it is at a position corresponding to the slope of the retreat portion, since the blade carrier and the blocking position slider are not interlocked when it is at such a position, resulting in safety hazards.

Therefore, further improvement to the utility knife is required.

SUMMARY OF THE INVENTION

It is a first object of the present invention to provide a utility knife with reduced components and more convenient assembly.

It is a second object of the present invention to provide a utility knife in which the blade carrier can be immediately prevented by the position control component from sliding forward independently after the application of an external force the position control component.

For achieving the first object, the utility knife comprises:

a housing, having a chamber, a front opening communicated with the chamber;

a blade carrier, movably disposed inside the chamber;

a blade, removably attached to the blade carrier, capable of passing through the front opening when the blade carrier slides toward the front opening;

a position control component;

a safety control component, connected to the blade carrier to push the blade carrier in and out of the front opening;

wherein:

a slide rail is disposed in the chamber for the position control component to slide, the slide rail has a plurality of blocking positions which comprises a first blocking position and at least one second blocking position disposed on the slide rail at intervals along a sliding direction of the position control component; the position control component has a positioning portion matching to the first blocking position and the second blocking position, when the position control component slides along the slide rail forward and backward relative to the housing, the positioning portion positions in different blocking positions and accordingly the blade extends out of the front opening; a positioning direction is defined at an angle to the sliding direction of the position control component, the first blocking position is farther away from the positioning portion of the position control component than the rest areas of the slide rail except the first blocking position.

when the positioning portion of the position control component is located in the first blocking position, the position control component does not block the blade carrier and the blade carrier can move forward when pushed by the safety control component;

when the positioning portion of the position control component is located at a position outside the first blocking position, the position control component blocks the blade carrier from moving and the blade carrier can move forward only under control of the position control component.

There may be various designs for the first blocking position, the second blocking position and the positioning portion. Preferably, the first blocking position is a first recess formed on the slide rail for receiving the positioning portion, and the second blocking position is a second recess formed on the slide rail for receiving the positioning portion; the depth of the first recess is greater than the depth of the second recess, so that in the positioning direction, the bottom of the first recess is farther away from the positioning portion than the rest areas of the slide rail except the first recess;

the positioning portion is a positioning protrusion.

The arrangement of the positioning protrusion, the first recess and the second recess realizes reasonable and simple structure and high stability, and the structure is not easy to fail.

Preferably, the forward direction of the movement of the blade carrier is defined as an advancing direction, a blocking direction is defined as transversal to the advancing direction;

the blade carrier has a first limiting portion and a second limiting portion, the first limiting portion extends in the blocking direction, and the second limiting portion is disposed on the rear side of the first limiting portion and extends in the blocking direction;

the position control component has a transmission portion, and the positioning portion is disposed on the rear side of the transmission portion and on the front side of the second limiting portion;

when the positioning portion of the position control component is at the first blocking position, the transmission portion does not interfere with the first limiting portion, the positioning portion and the second limiting portion do not overlap in the advancing direction, the blade carrier is capable of being driven to slide forward and backward by sliding the safety control component to drive the blade to extend into and out of the front opening;

when the positioning portion of the position control component is at a position outside the first blocking position, the transmission portion and the first limiting portion at least partially overlap in the advancing direction, the positioning portion and the second limiting portion at least partially overlap in the advancing direction, sliding the position control component forward enables the transmission portion of the position control component to be in blocking with the first limiting portion thus to drive the blade carrier to move forward and prevent it from returning backward.

With such design, in addition to the position-fit of the positioning portion of the position control component with the blocking positions for positioning the degree of extension of the blade out of the housing, the positioning portion can also be in interference fit with the second limiting portion and force, together with the transmission portion, the position control component to act on the blade carrier, so that the safety control component is unable to independently drive the blade carrier to slide forward and thus the blade carrier is unable to independently go into and out of the housing. That is, the positioning portion has two functions. Compared with the only function of the positioning portion in positioning the degree of extension of the blade out of the housing, this solution has fewer parts and a more compact structure. In addition, when the positioning component acts on the position control component to perform blocking position shift, the position control component can affect the blade carrier to determine whether the blade carrier can slide forward under the effect of the safety control component. When in use, the action is smooth and it is convenient to operate.

For achieving the second object, preferably, when the positioning portion of the position control component is at the first blocking position, the positioning portion and the second limiting portion are close to each other in the blocking direction, with a small distance between them.

In this way, when the external force starts to act on the position control component, the positioning portion originally located within the first blocking position will move toward the blade carrier in the contact-fit direction. Because of the small distance, the positioning portion can immediately start to overlap with the second limiting portion in the front-to-rear direction, that is, the position control component can be immediately brought into contact-fit with the blade carrier. At this time, if the utility knife is used abnormally or violently, the blade will not be thrown out, resulting in high safety.

In order to immediately drive the blade to extend and retract when the position control component slides in the front-to-rear direction, preferably, when the positioning portion is located at the first blocking position, the transmission portion and the first limiting portion partially overlaps each other; at this time, the distance between the transmission portion and the first limiting portion in the advancing direction of the blade carrier becomes smaller;

and/or, when the positioning portion and the second limiting portion at least partially overlap in the advancing direction, the positioning portion and the second limiting portion are close to each other in the advancing direction of the blade carrier and the distance between positioning portion and the second limiting portion becomes smaller;

and/or, a limiting groove is disposed on the back of the blade carrier, a limiting column and a third spring sleeved on the limiting column are disposed between the limiting groove and an inner wall of the housing, the head of the limiting column is in fit with the limiting groove, one end of the third spring is resisted against the limiting column and the other end against the inner wall of the housing, the third spring has a tendency to support the limiting column, so that the head of the limiting column snaps into the limiting groove.

Because the front-to-back distance between the transmission portion and the first limiting portion is small, when the position control component slides forward, it can immediately act on the first limiting portion through the transmission portion to drive the blade to extend out of the front opening. In addition, when the positioning portion is located at the first blocking position, the transmission portion and the first limiting portion have partially overlapped in the advancing direction; in this way, the operation feel is great, there will be no jams, and the operation is relatively smooth;

and/or, when the position control component slides backward, it can act on the second limiting portion through the positioning portion to drive the blade to gradually retract into the housing; in this way, the forward and backward sliding of the position control component can be immediately reflected as the extension and retraction of the blade, almost no delay, so that the extension and retraction of the blade is quick;

and/or, by disposing the limiting column, the blade carrier is limited. When the positioning portion is located at the first blocking position, if the utility knife is used abnormally or violently, because the limiting column limits the blade carrier, it is less likely for the blade carrier to move forward independently, so that the blade will not be thrown out to hurt the user or other people.

In order to increase friction and to ensure uniform stress, preferably, at least one of the transmission portion and the first limiting portion is a first plane at a position where the two resist against each other;

and/or, at least one of the positioning portion and the second limiting portion is a second plane at a position where the two resist against each other.

In this way, through the first plane, the contact area of the transmission portion and the first limiting portion at the position where the two resist against each other is large, which is beneficial to increase the friction between the two to avoid slippage, and this also ensures the uniform stress between the two, which is beneficial for the stable sliding of the blade carrier. Moreover, by disposing the first plane, the overlapping range of the transmission portion and the first limiting portion is large, which reduces the requirements on assembly accuracy, so that the transmission portion can be in contact-fit with the first limiting portion even if there is slight alignment in position during the assembly;

and/or, similarly, through the second plane, the friction between the positioning portion and the second limiting portion is great, which avoids slippage, and this also ensures the uniform stress between the two, which is beneficial for the stable sliding of the blade carrier. The requirements on assembly accuracy are also low.

In order to make the position control component move away from the blade carrier automatically without interference between the positioning portion and the second limiting portion, preferably, the utility knife further comprises a sliding component and a first elastic component;

the sliding component is slidably disposed in the chamber of the housing and is used for supporting the position control component;

the first elastic component extends in the blocking direction and is used for supporting the position control component, so that the position control component moves away from the blade carrier and the positioning portion has a tendency to not interfere with the second limiting portion; one end of the first elastic component is resisted against the sliding component and the other end thereof is resisted against the position control component.

In this way, after the external force applied to the position control component is removed, under the action of the first elastic component, the position control component automatically moves away from the blade carrier and returns to a state where the positioning portion does not interfere with the second limiting portion. It is more labor-saving.

There may be various designs for the first elastic component. Preferably, the first elastic component is a first spring or a first elastic strip; one end of the first spring or the first elastic strip is resisted against the sliding component and the other end thereof is resisted against the position control component.

There may be various designs for the sliding component. Preferably, the sliding component is a sliding block or a sliding plate.

In order to enable the blade to automatically retract into the housing when not in use, preferably, the utility knife further comprises a second elastic component, which enables the blade carrier to slide backward to have a tendency to get close to the position control component backward; the second elastic component extends along the sliding direction of the blade carrier; one end of the second elastic component is connected to the blade carrier, and the other end thereof is connected to the sliding component or the inner wall of the housing;

by sliding the position control component backward, the positioning portion thereof is capable of being blocking with the second limiting portion backward, or/and the first limiting portion is capable of being blocking with the transmission portion backward, or/and the second elastic component is capable of being allowed to act on the blade carrier backward to drive the blade carrier to move backward.

In this way, after the external force applied to the safety control component is removed, under the action of the second elastic component, the blade carrier automatically slides toward the rear of the housing, and the blade is driven to automatically retract into the housing. It is labor-saving and this prevents the blade exposed out of the housing to hurt the user or other people.

There may be various designs for the second elastic component. Preferably, the second elastic component is a tension spring or a rubber ring; one end of the tension spring or rubber ring is connected to the blade carrier, and the other end thereof is connected to the sliding component or the inner wall of the housing.

In order to guide the sliding of the position control component, preferably, the housing has a first chute communicated with the chamber and disposed on a side surface; the head of the position control component is disposed in the first chute, and the first chute is used for guiding the sliding of the position control component; the slide rail is located on the inner wall corresponding to the first chute. Guided by the first chute, the position control component can slide quickly.

In order to guide the sliding of the safety control component, preferably, the housing has a second chute communicated with the chamber and disposed on a top surface; the head of the safety control component is disposed in the second chute, and the second chute is used for guiding the sliding of the safety control component; the extension length of the second chute corresponds to the extension length of the first chute. Guided by the second chute, the safety control component can slide quickly.

Compared with the prior art, the present invention has the following beneficial effects: in the positioning direction, the first blocking position is farther away from the positioning portion of the position control component than the rest areas on the slide rail except the first blocking position. In this way, in addition to blocking position shift, the position control component can also be used for contact-fitting with the blade carrier to determine whether the blade carrier can slide forward independently, without requiring any pin, pin hole, retreat portion, support surface, and elastic component disposed on the pin to apply an elastic force to the support surface and the retreat portion, etc., also without requiring any elastic lock plate, lock tongue, support surface and retreat portion. Therefore, the utility knife of the present invention has fewer components, resulting in low material cost, and fewer assembly steps, and convenient and time-saving assembly process.

In addition, the utility knife of the present invention does not have small components such as pin shafts, lock tongues, etc., therefore the assembly accuracy is low and the assembly is more convenient and time-saving, and the components are not easy to lose.

DETAILED DESCRIPTION OF THE INVENTION

Figure 1:
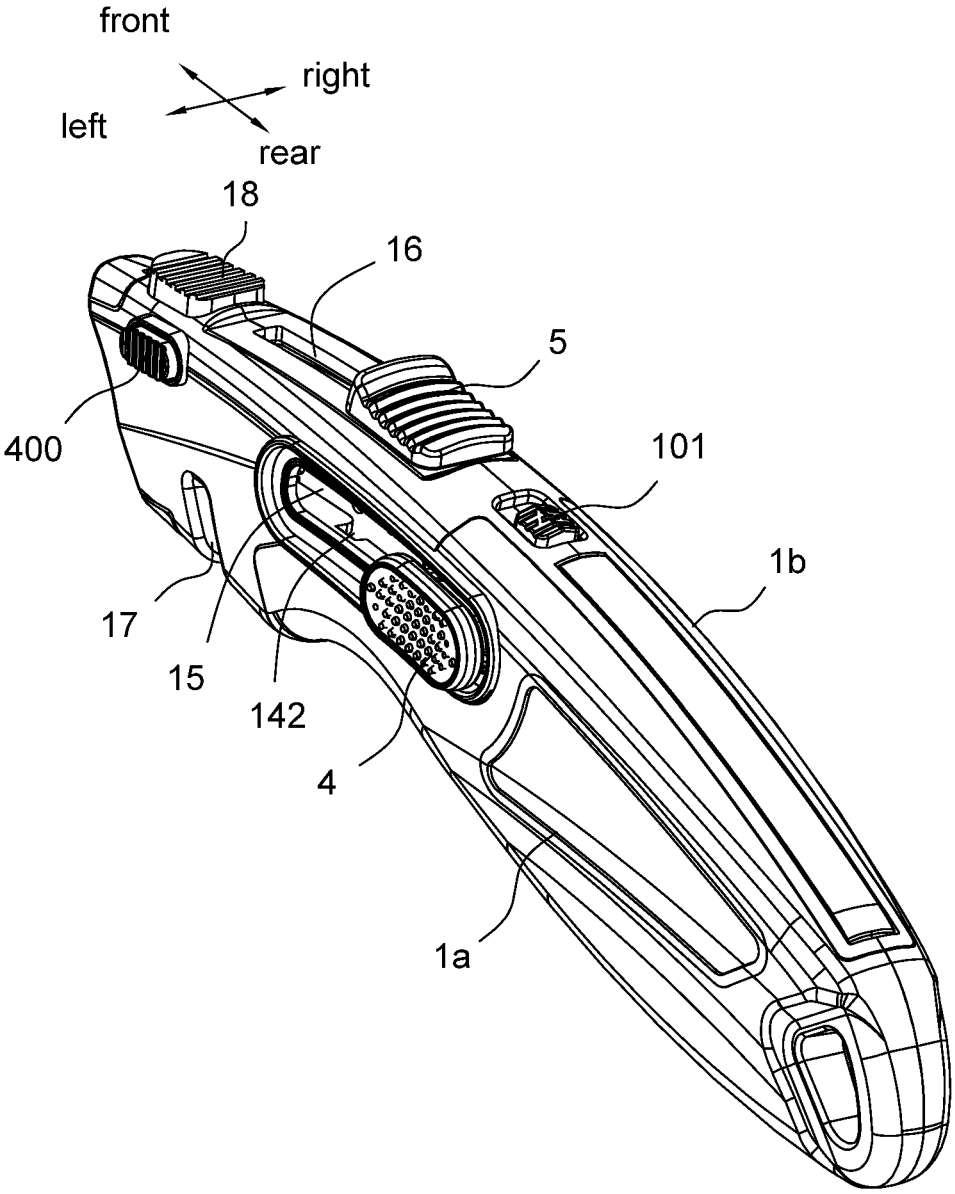
FIG. 1 is a perspective view of a utility knife according to an embodiment of the present invention.

The present invention will be further described below in detail with reference to the accompanying drawings by embodiments.

FIGS. 1 to 18 show a preferred embodiment of the utility knife of the present invention.

The utility knife comprises main components such as a housing 1, a blade carrier 2, a blade 3, a position control component 4, a safety control component 5, a first elastic component 7, and a second elastic component 8.

The housing 1 comprises a chamber 11, a front opening 12 communicated with the chamber 11, a slide rail 13 disposed in the chamber 11 for the position control component 4 to slide, a first chute 15 communicated with the chamber 11, a second chute 16 communicated with the chamber 11, and a rubber force-application portion 18 on the top. In order to facilitate the installation, the housing 1 comprises a left housing 1*a* and a right housing 1*b* that can be folded together. The left housing 1*a* and the right housing 1*b* are folded to form the chamber 11. In order to cut the band, on the bottom of the front side of the housing 1, there is a cutting opening 17 for the blade 3 to expose the blade edge.

The slide rail 13 may have different shapes. For example, it may be roughly a sliding plane, or it may be uneven.

The slide rail 13 has a plurality of blocking positions 14. The blocking positions 14 comprises a first blocking position 141 and at least one second blocking position 142 disposed on the slide rail 13 at intervals along a sliding direction A of the position control component 4. The first blocking position 141 is disposed on the rear side of the housing 1, and the two second blocking positions 142 are both disposed on the front side of the first blocking position 141. Of course, a different number of second blocking positions 142 may be provided, if required. For example, there may be three to five second blocking positions 142. The first blocking position 141 may be located between two of the second blocking positions 142. The number of second blocking positions 142 before and after the first blocking position 141 may be the same or different.

Figure 2:
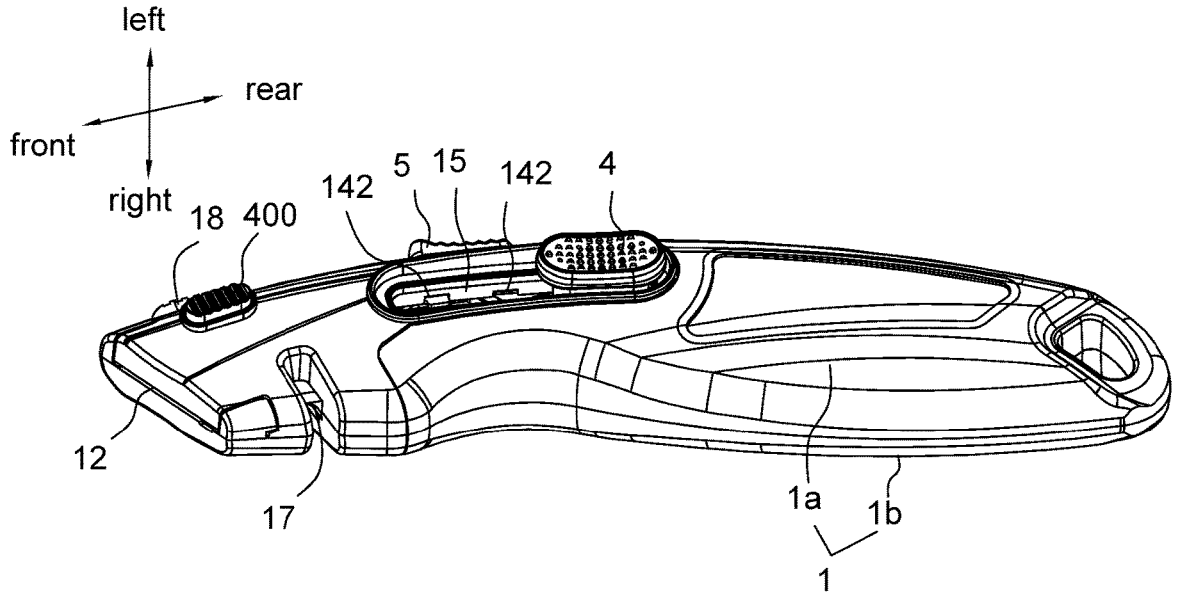
FIG. 2 is a perspective view of FIG. 1 from another view.
Figure 3:
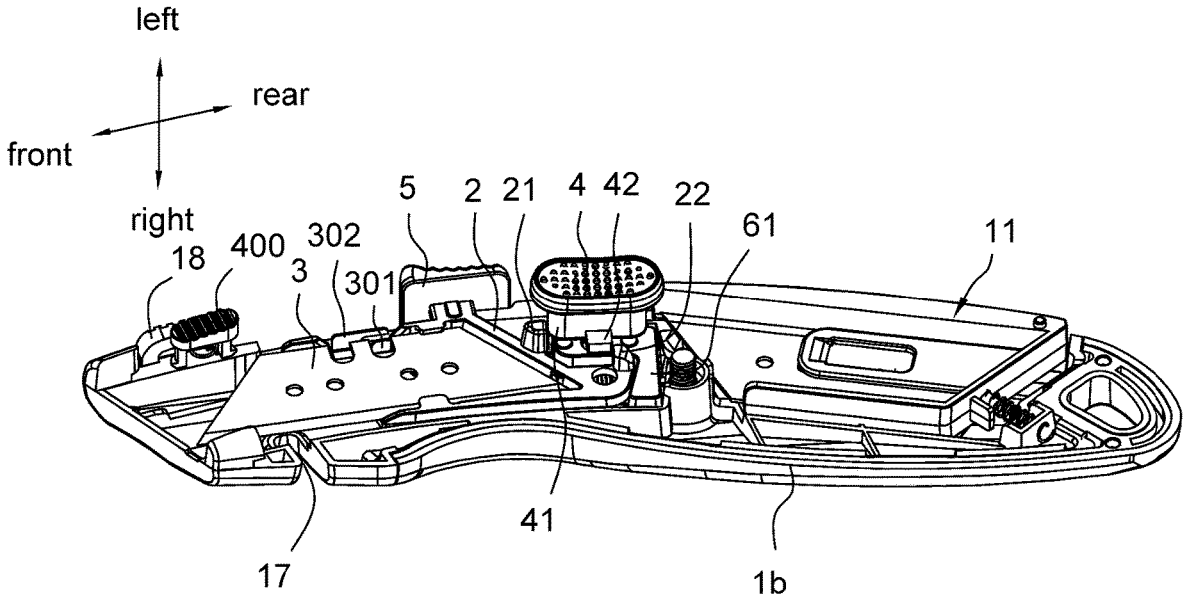
FIG. 3 is a perspective view of FIG. 1, with the left housing removed.

The housing 1 comprises a positioning direction B defined at an angle to the sliding direction A of the position control component 4. Preferably, the sliding direction A is substantially perpendicular to the positioning direction B. In this embodiment, as shown in FIGS. 1-3, the sliding direction A corresponds to the front-to-rear direction, and the positioning direction B corresponds to the left-to-right direction. In the positioning direction B, the first blocking position 141 is farther away from a positioning portion 42 of the position control component 4 than the rest areas of the slide rail 13 except the first blocking position 141 (in this embodiment, areas on the slide rail 13 between the first blocking position 141 and the most front second blocking position 142 within the two second blocking position 142).

Figure 4:
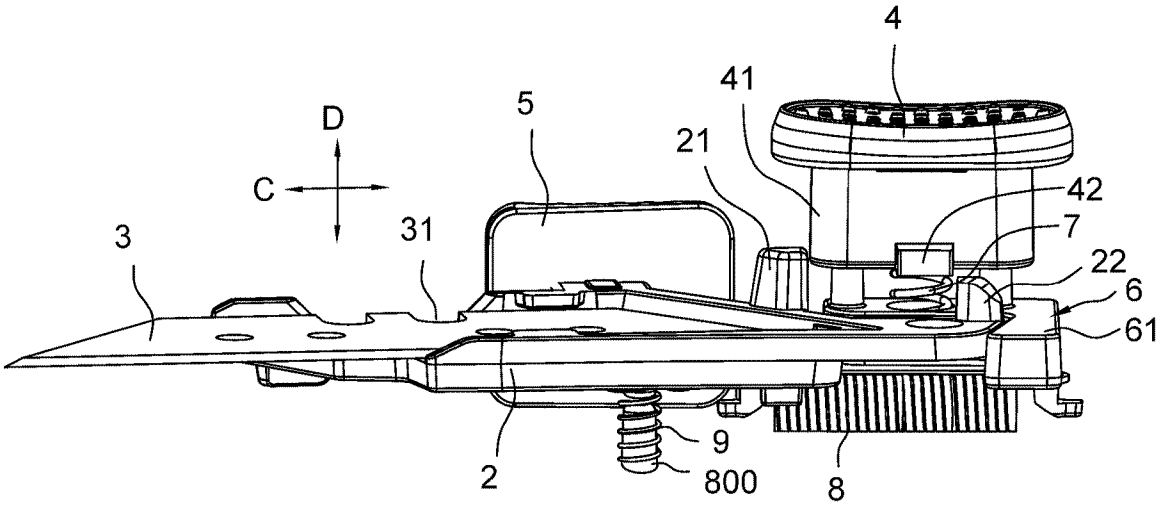
FIG. 4 is a perspective view showing the assembly of the blade carrier, blade, position control component, safety control component, first elastic component, second elastic component, etc., in the embodiment of the present invention (the first elastic component supports the position control component to the left, and the positioning portion of the position control component is located in the first blocking position, the positioning portion and the second limiting portion do not overlap in the advancing direction, and the position control component does not interfere with the blade carrier)
Figure 5:
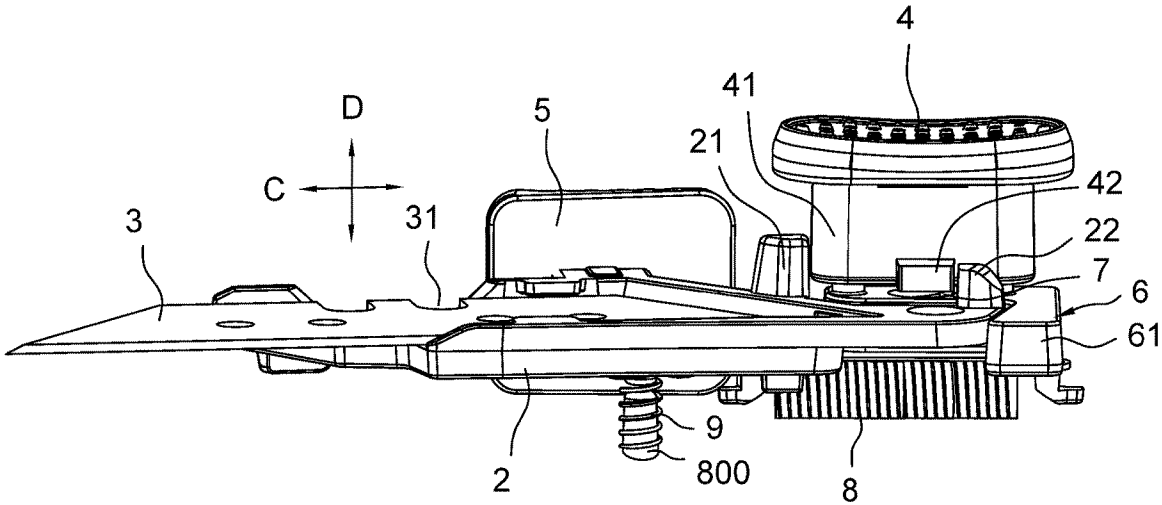
FIG. 5 is a perspective view showing another state of FIG. 4 (after pressing the position control component to the right, the positioning portion of the position control component is disengaged from the first blocking position, and the positioning portion of the position control component and the second limiting portion overlap in the advancing direction, the position control component can be brought into contact-fit with the blade carrier, and the safety control component cannot be moved)
Figure 6:
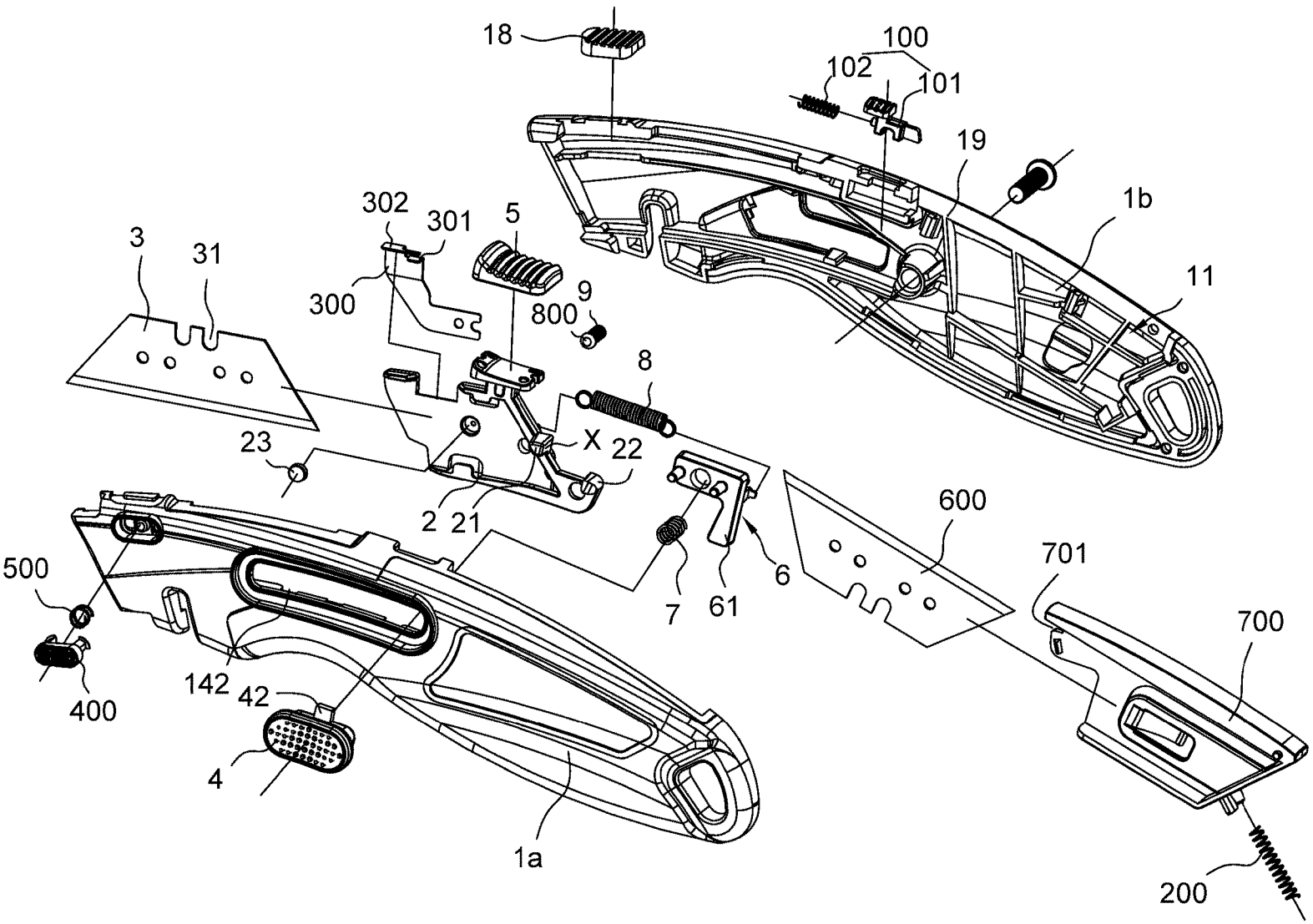
FIG. 6 is an exploded view of the utility knife according to the embodiment of the present invention.
Figure 7:
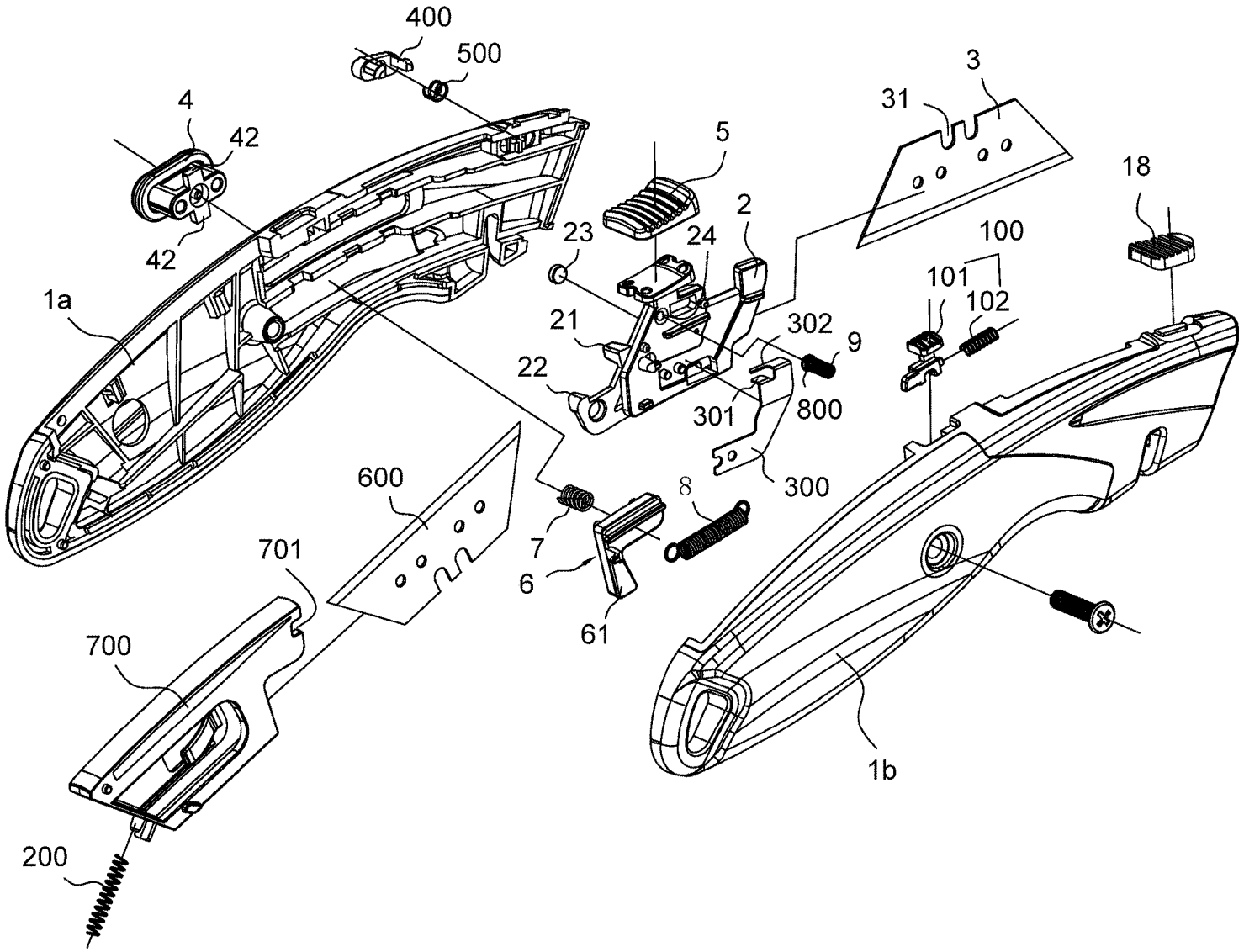
FIG. 7 is a perspective view of FIG. 6 from another view.
Figure 8:
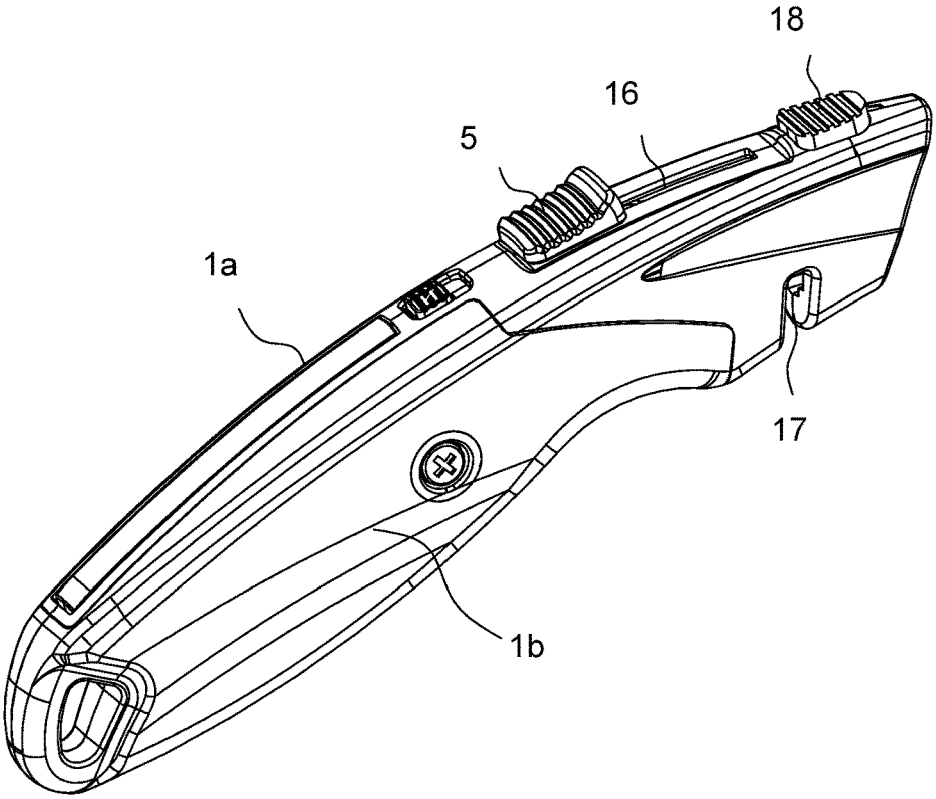
FIG. 8 is a perspective view of FIG. 1 from another view.
Figure 9:
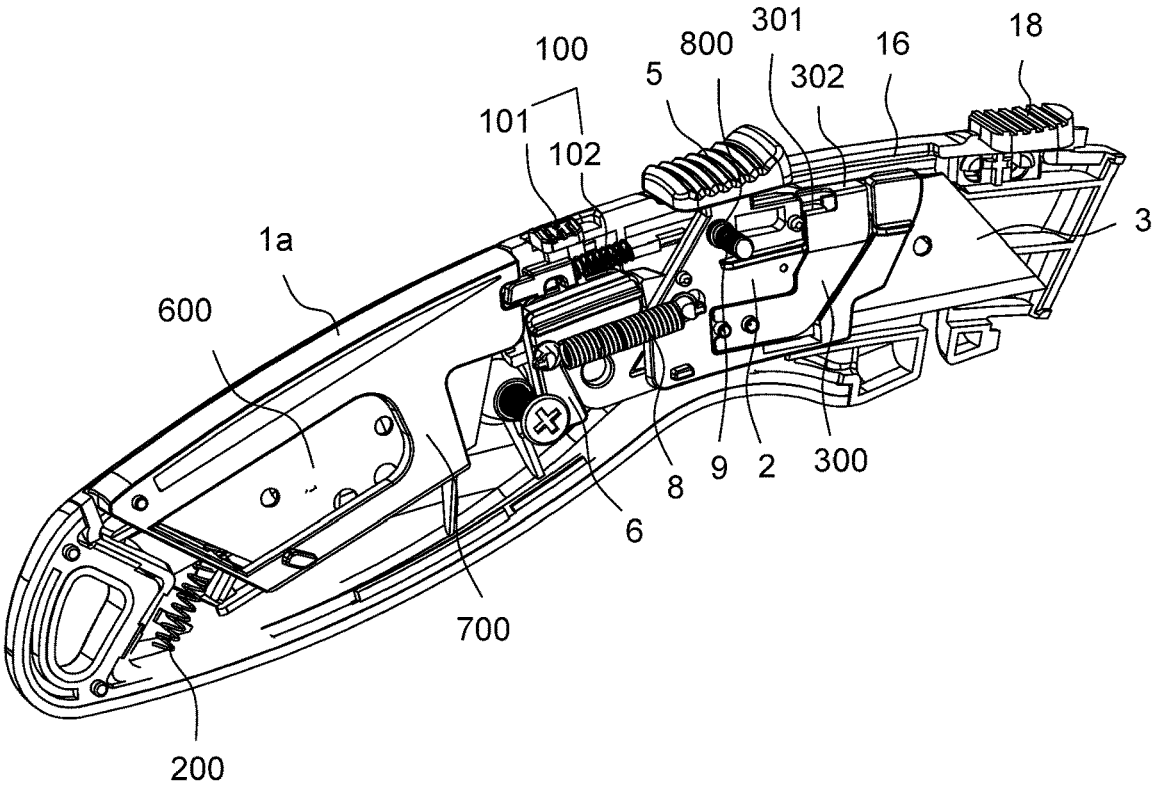
FIG. 9 is a perspective view of FIG. 8, with the right housing removed.
Figure 10:
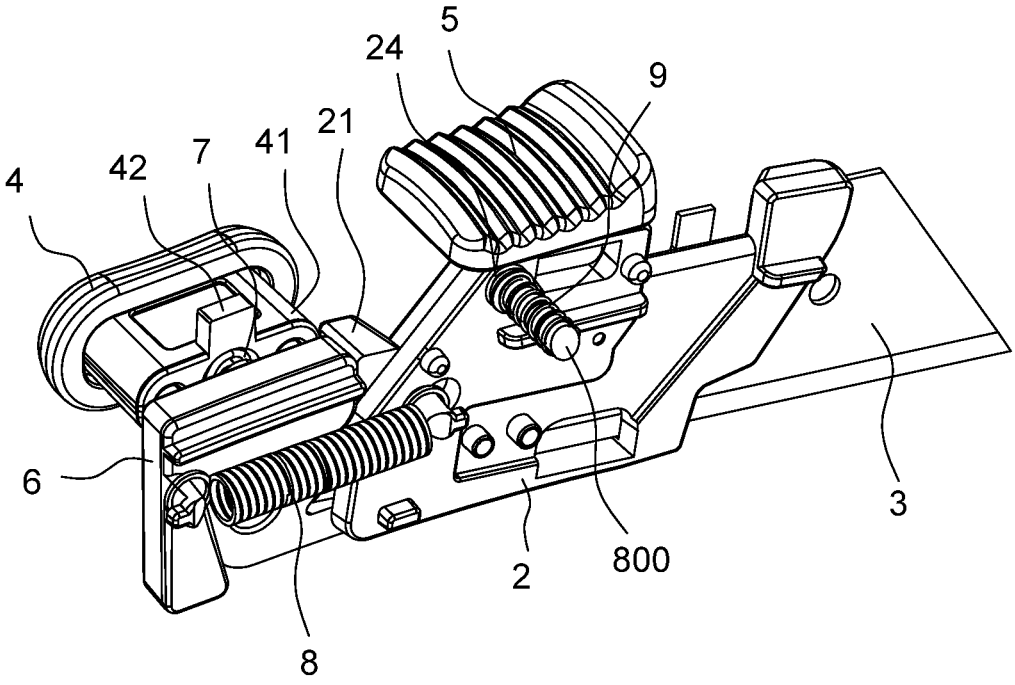
FIG. 10 is a perspective view showing the assembly of the blade carrier, blade, position control component, safety control component, second elastic component, etc., in FIG. 9.
Figure 11:
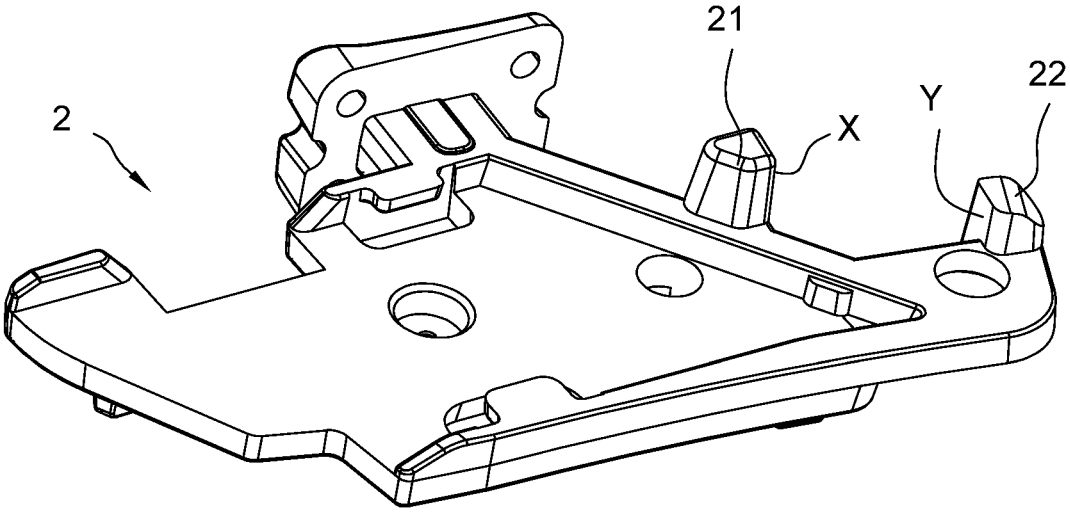
FIG. 11 is a perspective view of the blade carrier according to the embodiment of the present invention.
Figure 12:
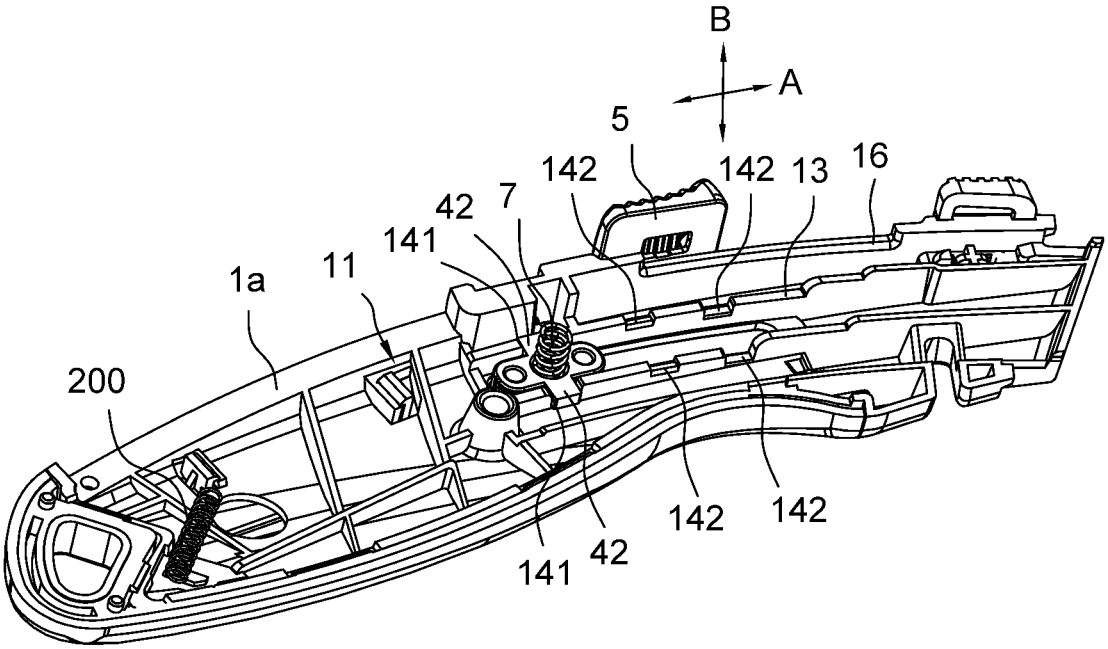
FIG. 12 is a assembly perspective view showing the assembly of the left housing, position control component, safety control component, first elastic component, etc., according to the embodiment of the present invention.
Figure 13:
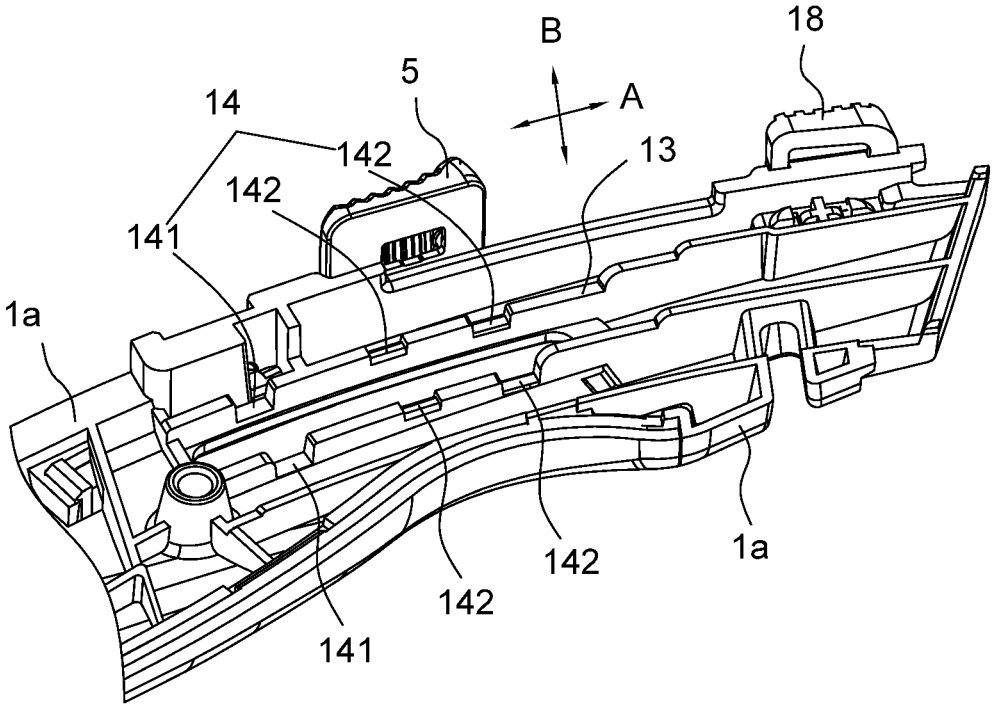
FIG. 13 is a perspective view of the partial left housing of FIG. 12.

The blade carrier 2 is movably disposed inside the chamber 11 of the housing 1. The forward direction of the movement of the blade carrier 2 is defined as an advancing direction C, a blocking direction D is defined as transversal to the advancing direction C. In this embodiment, as shown in FIGS. 4-5, the advancing direction C corresponds to the front-to-rear direction, and the blocking direction D is substantially perpendicular to the advancing direction C. The blade carrier 2 is also provided with magnetic steel 23 for absorbing the blade 3 so that the blade 3 is not likely to slip off the blade carrier 2.

The blade carrier 2 has a first limiting portion 21 and a second limiting portion 22, the first limiting portion 21 extends in the blocking direction D, and the second limiting portion 22 is disposed on the rear side of the first limiting portion 21 and extends in the blocking direction D. In addition, a limiting groove 24 is disposed on the back of the blade carrier 2, a limiting column 800 and a third spring 9 sleeved on the limiting column 800 are disposed between the limiting groove 24 and an inner wall of the housing 1, both the limiting column 800 and the third spring 9 extend in the blocking direction D, the head of the limiting column 800 is in fit with the limiting groove 24, one end of the third spring 9 is resisted against the limiting column 800 and the other end against the inner wall of the housing 1, the third spring 9 has a tendency to support the limiting column 800, so that the head of the limiting column 800 snaps into the limiting groove 24. By disposing the limiting column 800, the blade carrier 2 is limited. When the positioning portion 42 is located in the first blocking position 141, if the utility knife is used abnormally or violently, because the limiting column 800 limits the blade carrier 2, it is less likely for the blade carrier 2 to move forward independently, so that the blade 3 will not be thrown out to hurt the user or other people.

The blade 3 is removably attached to the blade carrier 2, and is capable of passing through the front opening 12 when the blade carrier 2 slides toward the front opening.

The position control component 4 has a transmission portion 41 and the positioning portion 42. The transmission portion 41 does not interfere with the first limiting portion 21 or can be in blocking with the first limiting portion 21. The positioning portion 42 is disposed on the rear side of the first limiting portion 21 and on the front side of the second limiting portion 22. The positioning portion 42 plays two roles. First, the positioning portion 42 is matching to the first blocking position 141 and each of the second blocking position 142, respectively. Second, the positioning portion 42 does not interfere with the second limiting portion 22 or can be in blocking with the second limiting portion 22.

The interaction process of the positioning portion 42 with the first blocking position 141 and each of the second blocking position 142 will be described below.

Due to an external force, when the position control component 4 slides along the slide rail 13 forward and backward relative to the housing 1, the positioning portion 42 positions in different blocking positions 14 and accordingly the blade 3 extends out of the front opening 12.

There may be various shapes for the positioning portion 42, the positioning portion 42 may be a positioning protrusion, or may be a positioning bar, a positioning plate, etc. A different number of positioning portions 42 may be provided, if required. In this embodiment, to enable stable sliding of the position control component 4, there are two positioning portions 42. The two positioning portions 42 are disposed on the top and bottom of the position control component 4 (when viewed from the angle of FIG. 1), respectively. Correspondingly, there are two sets of blocking positions 14. The two positioning portions 42 are correspondingly fitted with the two sets of blocking positions 14.

When the positioning portion 42 of the position control component 4 is located in the first blocking position 141, the position control component 4 does not block the blade carrier 2 and the blade carrier 2 can move forward when pushed by the safety control component 5. Since, when the positioning portion 42 of the position control component 4 is located in the first blocking position 141, the first limiting portion 21 of the blade carrier 2 is located on the front side of the positioning portion 42 of the position control component 4 (at this time, the two may or may not overlap in the front-to-rear direction) and the second limiting portion 22 of the blade carrier 2 does not overlap with the positioning portion 42 of the position control component 4 in the front-to-rear direction, sliding the safety control component 5 forward and backward can drive the blade carrier 2 to independently slide forward and backward. Thus, the blade 3 on the blade carrier 2 goes into and out of the front opening 12 of the housing 1. That is, in this case, the position control component 4 does not interfere with the forward and backward sliding of the blade carrier 2. This corresponds to the safety mode of the utility knife.

Figure 15:
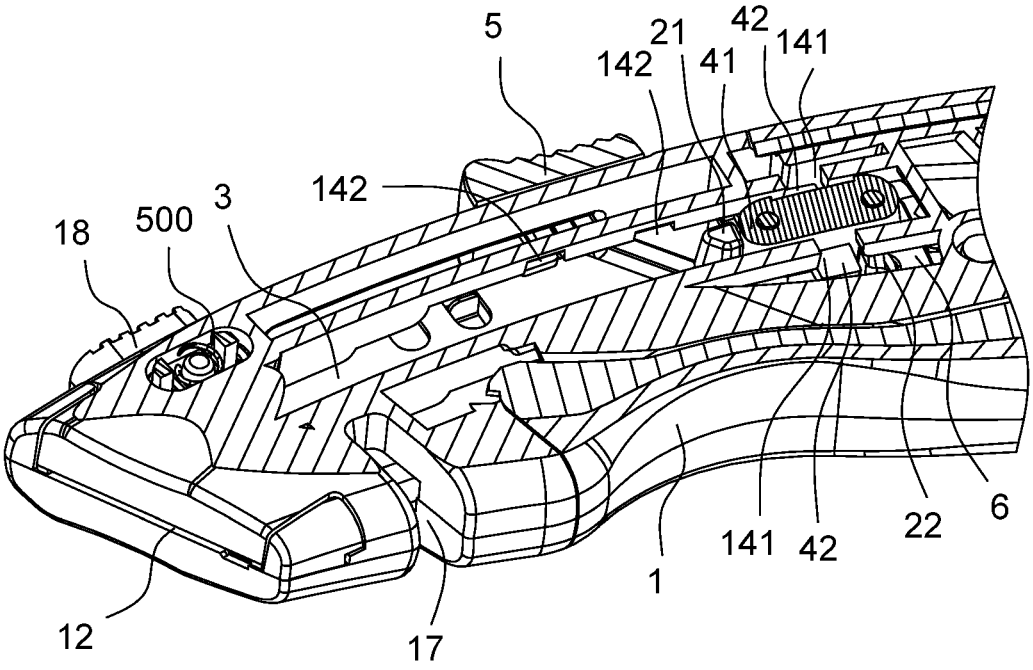
FIG. 15 is a sectional view showing another state of FIG. 14 (the position control component is disengaged from the first blocking position, the positioning portion and the second limiting portion overlap in the advancing direction, and the transmission portion and the first limiting portion overlap in the advancing direction, and the position control component is in contact-fit with the blade carrier)
Figure 16:
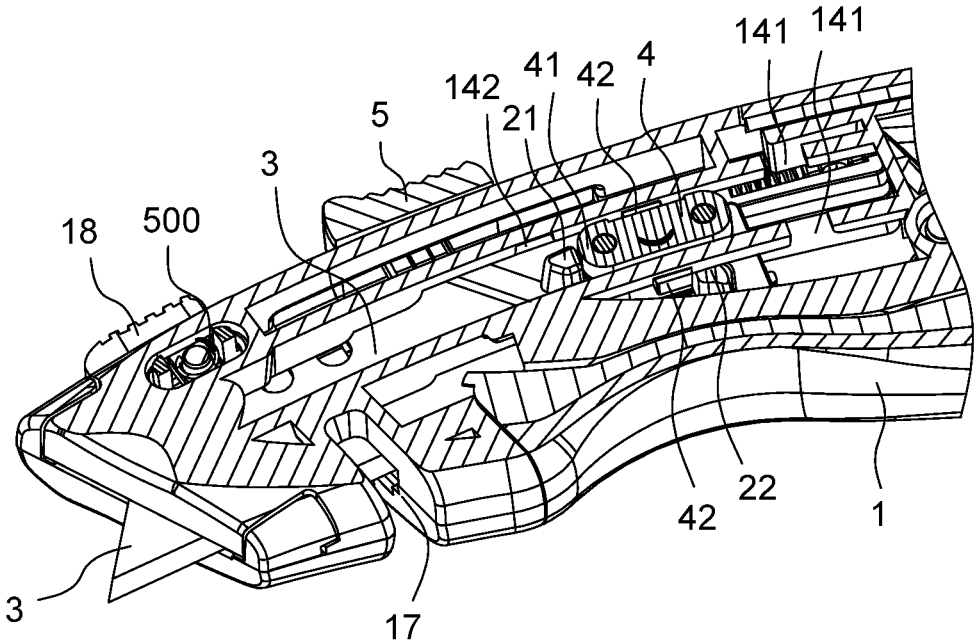
FIG. 16 is a sectional view showing one more state of FIG. 14 (the position control component is located in the second blocking position, the positioning portion and the second limiting portion overlap in the advancing direction, and the transmission portion and the first limiting portion overlap in the advancing direction, and the position control component is in contact-fit with the blade carrier)
Figure 17:
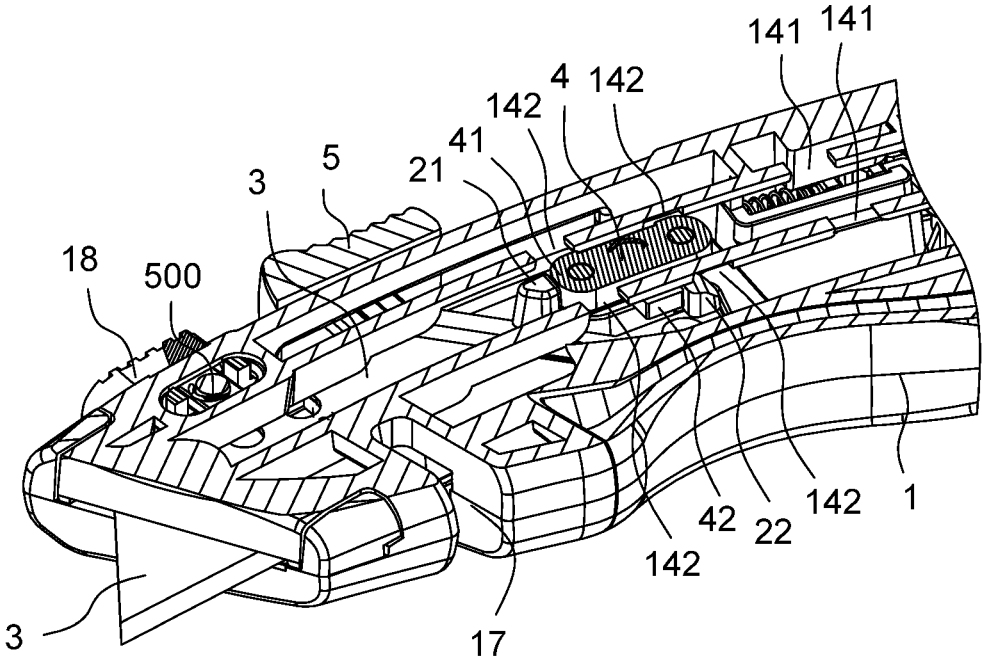
FIG. 17 is a sectional view showing one more state of FIG. 14 (the position control component is located between two second blocking position, the positioning portion and the second limiting portion overlap in the advancing direction, and the transmission portion and the first limiting portion overlap in the advancing direction, and the position control component is in contact-fit with the blade carrier)
Figure 18:
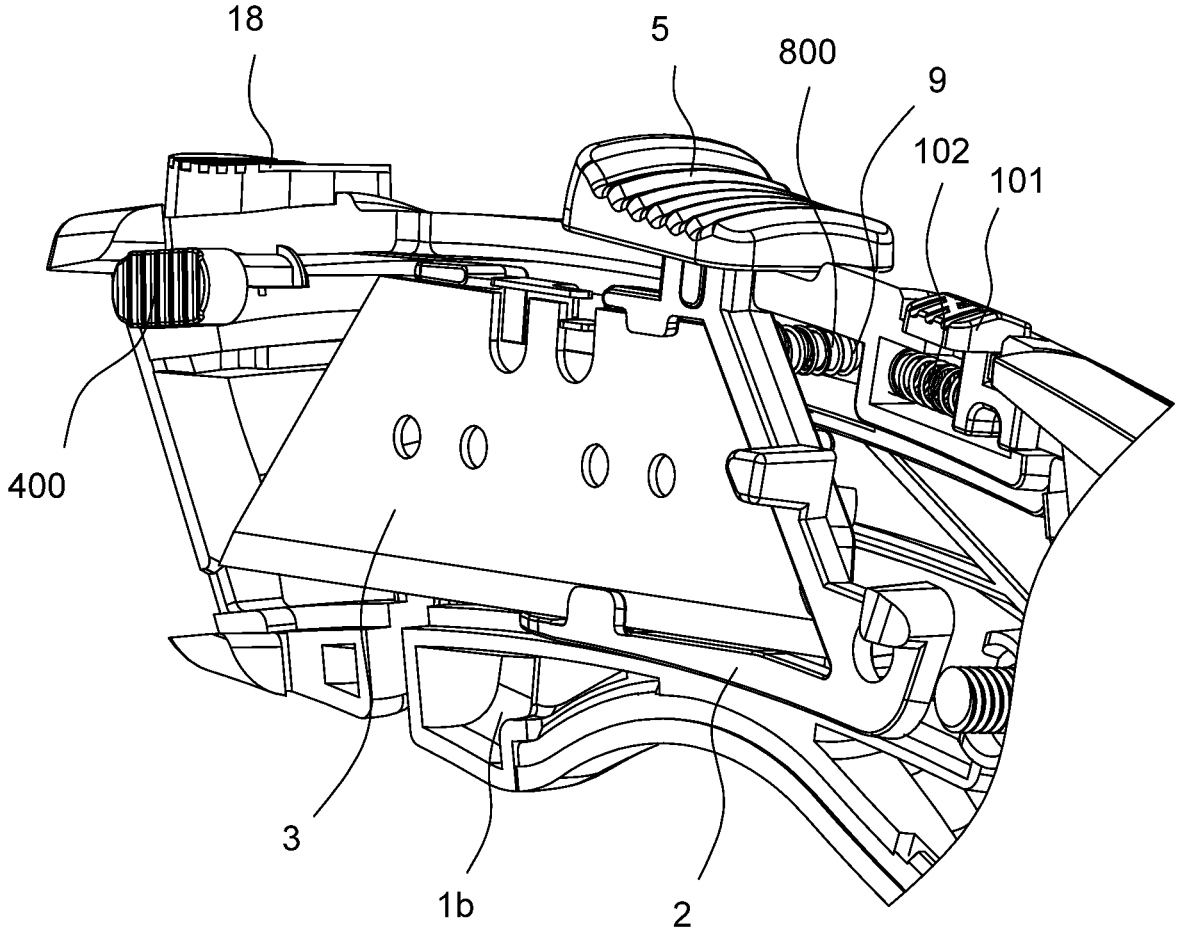
FIG. 18 is a perspective view showing the assembly of the blade carrier, limiting column, third spring, etc., according to the embodiment of the present invention.

When the positioning portion 42 of the position control component 4 is located at a position outside the first blocking position 141 (in this embodiment, when the positioning portion 42 is disengaged from the first blocking position 141 and does not yet slide along the slide rail 13, as shown in FIG. 15; or, when the positioning portion 42 is located in the second blocking position 142, for example FIG. 16; or, when the positioning portion 42 is located in areas on the slide rail 13 between the first blocking position 141 and the most front second blocking position 142, for example FIG. 17), the position control component 4 blocks the blade carrier 2 from moving and the blade carrier 2 can move forward only under control of the position control component 4. The expression "blocks the blade carrier 2" here means that the position control component 4 needs to be pushed to move forward so that the position control component 4 is in contact with the blade carrier 2 to drive the blade carrier 2 to move forward. When the positioning portion 42 of the position control component 4 is disengaged from the first blocking position 141 and does not yet slide along the slide rail 13, although the position control component 4 is not in contact with the blade carrier 2, the blade carrier cannot slide forward independently (because the positioning portion 42 of the position control component 4 hinders the second limiting portion 22 of the blade carrier 2 ahead). Or, when the positioning portion 42 of the position control component 4 is disengaged from the first blocking position 141 and does not yet slide along the slide rail 13, the position control component 4 has been in contact with the blade carrier 2, and thus the blade carrier 2 cannot slide forward independently.

There may be various shapes for the first blocking position, the second blocking position and the positioning portion 42. In this embodiment, the first blocking position 141 is a first recess formed on the slide rail 13 recessed at the positioning direction B for receiving the positioning portion 42, and the second blocking position 142 is a second recess formed on the slide rail 13 recessed at the positioning direction B for receiving the positioning portion 42; the depth of the first recess is greater than the depth of the second recess, so that in the positioning direction B, the bottom of the first recess is farther away from the positioning portion 42 than the rest areas of the slide rail 13 except the first recess; the positioning portion 42 is a positioning protrusion.

In other embodiments, it may be possible that the first blocking position 141 is a first positioning protrusion and the second blocking position 142 is a second positioning protrusion. In the positioning direction B, the first positioning protrusion is farther away from the blade carrier 2 than each second positioning protrusion. Grooves, which are fitted with the first positioning protrusion and the second positioning protrusion, are then disposed on the position control component 4.

In addition, the action of the positioning portion 42 on the second limiting portion 22 will be described below.

The main principle is that the positioning portion 42 interacts with the second limiting portion 22.

Figure 14:
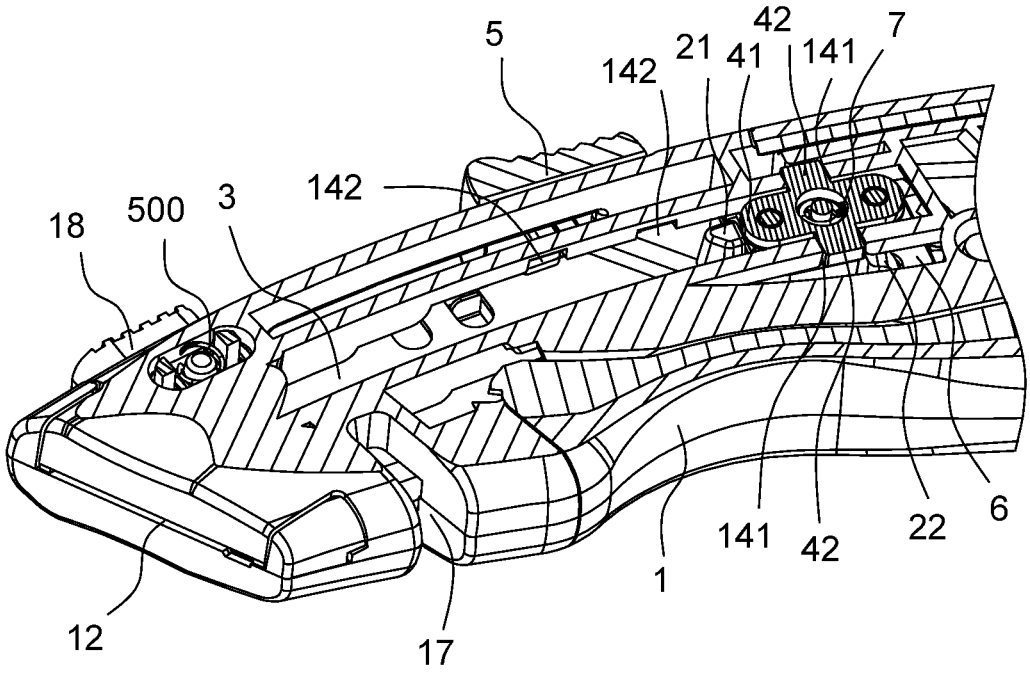
FIG. 14 is a sectional view of the utility knife according to the embodiment of the present invention cutting the position control component (the position control component is located in the first blocking position, the positioning portion and the second limiting portion do not overlap in the advancing direction, and the position control component does not interfere the blade carrier)

When the positioning portion 42 of the position control component 4 is at the first blocking position 141, as shown in FIG. 14, the transmission portion 41 does not interfere with the first limiting portion 21, the positioning portion 42 and the second limiting portion 22 do not overlap in the advancing direction C, the blade carrier 2 is capable of being driven to slide forward and backward by sliding the safety control component 5 to drive the blade 3 to extend into and out of the front opening 12;

When the positioning portion 42 of the position control component 4 is at a position outside the first blocking position 141 (that is, when the positioning portion 42 is disengaged from the first blocking position 141 and does not yet slide along the slide rail 13, as shown in FIG. 15; or, when the positioning portion 42 is located within the second blocking position 142, for example FIG. 16; or, when the positioning portion 42 is located in areas on the slide rail 13 between the first blocking position 141 and the most front second blocking position 142, for example FIG. 17), the transmission portion 41 and the first limiting portion 21 at least partially overlap in the advancing direction C, the positioning portion 42 and the second limiting portion 22 at least partially overlap in the advancing direction C, sliding the position control component 4 forward enables the transmission portion 41 of the position control component 4 to be in blocking with the first limiting portion 21 thus to drive the blade carrier 2 to move forward and prevent it from returning backward.

Sliding the position control component 4 backward to drive the blade carrier 2 to move backward may be realized by one of the following three ways: the positioning portion 42 is backward blocks h the second limiting portion 22, the first limiting portion 21 is backward blocks the transmission portion 41, and the second elastic component 8 acts on the blade carrier 2 backward. In this embodiment, sliding the position control component 4 backward may be realized by the following way: the positioning portion 42 of the position control component 4 is backward blocks the second limiting portion 22 so as to drive the blade carrier 2 to move backward.

For ease of the user's operation, the head of the position control component 4 is disposed in the first chute 15, and the first chute 15 is used for guiding the sliding of the position control component 4; the slide rail 13 is located on the inner wall corresponding to the first chute 15. The head of the position control component 4 may be a rubber sleeve with bumps, to increase friction.

To ensure that the position control component 4 can immediately prevent the blade carrier 2 to independently slide forward once an external force is applied to the position control component 4, it is proposed that, when the positioning portion 42 of the position control component 4 is at the first blocking position 141, the positioning portion 42 and the second limiting portion 22 are close to each other in the blocking direction D, with a small distance between them. In this way, when the external force starts to act on the position control component 4, the positioning portion 42 originally located within the first blocking position 141 will move toward the blade carrier 2 in the blocking direction D. Because of the small distance, the positioning portion 42 and the second limiting portion 22 can immediately get close to each other in the advancing direction C, that is, the position control component 4 can immediately prevent the blade carrier 2 to independently slide forward. At this time, if the utility knife is used abnormally or violently, the blade 3 on the blade carrier 2 will not be thrown out, resulting in high safety. To ensure quick extension and retraction of the blade 3, it is proposed that, when the positioning portion 42 is located at the first blocking position 141, the transmission portion 41 and the first limiting portion 21 partially overlaps each other in the advancing direction C. In this way, there will be no jams in operating the position control component 4, and the operation feel is great. The distance between the transmission portion 41 and the first limiting portion 21 in the advancing direction C of the blade carrier 2 becomes smaller. When the positioning portion 42 and the second limiting portion 22 at least partially overlap in the advancing direction C, the positioning portion 42 and the second limiting portion 22 are close to each other in the advancing direction C of the blade carrier 2 and the distance between positioning portion 42 and the second limiting portion 22 becomes smaller. In this way, the forward and backward sliding of the position control component 4 can be immediately reflected as the extension and retraction of the blade 3, almost no delay, so that the extension and retraction of the blade 3 is quick. In this embodiment, the first limiting portion 21 is a first plane X at a position where it is resisted against the transmission portion 41. In other embodiments, the first plane X may be disposed on the transmission portion 41. It is possible that both the transmission portion 41 and the first limiting portion 21 have a first plane X. In this embodiment, each of the positioning portion 42 and the second limiting portion 22 is a second plane Y at a position where the two are resisted against each other. In other embodiments, it is possible that one of the positioning portion 42 and the second limiting portion 22 has a second plane Y at a position where the two are resisted against each other. In this way, through the first plane X, the contact area of the transmission portion 41 with the first limiting portion 21 at the position where the two are resisted against each other is large, which is beneficial to increase the friction between the two to avoid slippage, and this also ensures the uniform stress between the two, which is beneficial for the stable sliding of the blade carrier 2. Moreover, by the arrangement of the first plane X, the overlapping range of the transmission portion 41 and the first limiting portion 21 is large, which reduces the requirements on assembly accuracy, so that the transmission portion 41 does not interfere with the first limiting portion 21 or can be in contact-fit with the first limiting portion 21 even if there is slight alignment in position during the assembly. Similarly, through the second plane Y, the friction between the positioning portion 42 and the second limiting portion 22 is great, which avoids slippage, and this ensures the uniform stress between the two, which is beneficial for the stable sliding of the blade carrier 2. The requirements on assembly accuracy are also low.

The safety control component 5 is connected to the blade carrier 2 to push the blade carrier 2 in and out of the front opening 12. The head of the safety control component 5 is disposed in the second chute 16 on the top of the housing 1, and the second chute 16 is used for guiding the sliding of the safety control component 5; the extension length of the second chute 16 corresponds to the extension length of the first chute 15.

The sliding component 6 is slidably disposed in the chamber 11 of the housing 1 and is used for supporting the position control component 4. In this embodiment, the sliding component 6 is a sliding block having an arm 61 that pushes the blade carrier 2 to move forward. In other embodiments, the size and shape of the sliding component 6 may be adjusted according to actual needs. For example, the sliding component 6 may be a sliding plate.

The first elastic component 7 extends in the blocking direction D and is used for supporting the position control component 4, so that the position control component 4 moves away from the blade carrier 2 and the positioning portion 42 has a tendency to not interfere with the second limiting portion 22; one end of the first elastic component 7 is resisted against the sliding component 6 and the other end thereof is resisted against the position control component 4. Preferably, in this embodiment, the first elastic component 7 is a first spring. Of course, the first spring may be a first elastic strip. One end of the first spring is resisted against the sliding component 6 and the other end thereof is resisted against the position control component 4.

The second elastic component 8 enables the blade carrier 2 to slide backward to have a tendency to get close to the position control component 4 backward. The second elastic component 8 extends along the sliding direction A of the blade carrier 2. One end of the second elastic component 8 is connected to the blade carrier 2, and the other end thereof is connected to the sliding component 6 or the inner wall of the housing 1. In this embodiment, the second elastic component 8 is a tension spring. One end of the tension spring is connected to the blade carrier 2, and the other end thereof is connected to the sliding component 6. In other embodiments, the second elastic component 8 may be a rubber ring or may be in other shapes. The other end of the tension spring may be directly connected to the inner wall of the housing 1.

As known, in this embodiment, by the interaction among the first blocking position 141, the second blocking position 142, the first limiting portion 21, the second limiting portion 22, the transmission portion 41, the positioning portion 42, the sliding component 6, the first elastic component 7 and the second elastic component 8, the position control component 4 does not interfere with the blade carrier 2 or can be blocking with the blade carrier 2, to determine whether the safety control component 5 can independently drive the blade carrier 2 to slide forward and backward.

In addition, to replace the blade 3 conveniently, a blade replacement switch 400 is disposed on the housing 1. The blade replacement structure between the blade replacement switch 400 and the blade 3 may be any well-known structure in the prior art. For example, a bayonet 31 may be disposed at the top end of the blade 3; an elastic lock plate 300 is disposed on the back of the blade carrier 2; the elastic lock plate 300 has a first flange 301 and a second flange 302 disposed above the first flange 301; and the first flange 301 is fitted and locked with the bayonet 31. In a state where the blade 3 is locked with the first flange 301, the second flange 302 is located above the blade 3 and the second flange 302 acts in cooperation with the blade replacement switch 400. The blade replacement switch 400 is movably disposed on the housing 1. A sixth spring 500 is disposed between the blade replacement switch 400 and the housing 1. By the sixth spring 500, the blade replacement switch 400 has a tendency to move away from the second flange 302 of the elastic lock plate 300. One end of the sixth spring 500 is resisted against the housing 1 and the other end thereof is resisted against the blade replacement switch 400.

To replace a worn blade 3 conveniently, the utility knife further comprises a spare blade 600. The fitting structure between the spare blade 600 and the housing 1 may be any well-known structure in the prior art. For example, the housing 1 also has a top opening 19 communicated with the chamber 11. The utility knife further comprises: a mount 700, a part of which can go into or out of the top opening 19; a locking switch 100 that locks the state of the mount 700 as being disposed in the chamber 11; and a fourth elastic component 200 that provides the mount 700 with a tendency to pop up from the housing 1. The spare blade 600 is detachably mounted on the mount 700. The locking switch 100 comprises a locking block 101 and a fifth elastic component 102. One end of the locking block 101 is resisted against a neck 701 on the mount 700, and the other end of the locking block 101 is resisted against one end of the fifth elastic component 102. The other end of the fifth elastic component 102 is connected to the housing 1. The top of the locking block 101 extends out of the housing 1. The fifth elastic component 102 can enable one end of the locking block 101 to return to a state where it is resisted against the neck 701. Both the fifth elastic component 102 and the fourth elastic component 200 may be springs or may be elastic strips.

The working principle and usage of the utility knife are described as below.

(1) In a safety mode, as shown in FIGS. 1-4 and FIG. 14, the first elastic component 7 supports the position control component 4, and the positioning portion 42 of the position control component 4 is at the first blocking position 141. At this time, the positioning portion 42 and the second limiting portion 22 do not overlap in the advancing direction C. The blade carrier 2 is capable of being driven to slide forward and backward by sliding the safety control component 5 to drive the blade 3 to extend into and out of the front opening 12. That is, the position control component 4 does not interfere with the blade carrier 2.

The safety control component 5 is released. Under the action of the second elastic component 8, the blade carrier 2 automatically moves toward the position control component 4, thus to drive the blade 3 to automatically retract into the chamber 11 of the housing 1, thereby preventing the exposed blade 3 from hurting the user or other people.

(2) When it is required to switch the blocking position 14, as shown in FIG. 15, the position control component 4 is pressed into the hosing 1 (as shown in FIG. 1, pressed to the right), so that the position control component 4 moves to the right. In this way, the positioning portion 42 of the position control component 4 is disengaged from the first blocking position 141 and does not yet slide forward. At this time, the positioning portion 42 and the second limiting portion 22 of the blade carrier 2 partially overlap in the advancing direction C, so the safety control component 5 cannot slide forward and thus cannot independently drive the blade carrier 2 to slide forward. Furthermore, since the positioning portion 42 and the second limiting portion 22 are close to each other in the blocking direction D with a small distance between them when there is no external force applied to the position control component 4, when the position control component 4 is started to be pressed to the right by an external force but not yet pushed forward, the positioning portion 42 originally located within the first blocking position 141 can immediately start to overlap with the second limiting portion 22 in the advancing direction C. That is, the position control component 4 can immediately prevent the blade carrier 2 to slide forward. At this time, if the utility knife is used abnormally or violently, the blade 3 will not be thrown out, resulting in high safety.

Then, the position control component 4 is pushed forward. The transmission portion 41 of the position control component 4 comes into contact with the first limiting portion 21 of the blade carrier 2 in the front-to-rear direction, so as to drive the blade carrier 2 to move forward. The blade 3 gradually extends out of the housing 1, until the positioning portion 42 is positioned at the corresponding second blocking position 142. When the positioning portion 42 is located at the second blocking position 142, the position control component 4 and the blade carrier 2 can be maintained in a contact state in the front-to-rear direction.

The position control component 4 is pushed backward, so that the positioning portion 42 of the position control component 4 is blocking with the second limiting portion 22 so as to drive the blade carrier 2 to move backward. The second elastic component 8 also drives the blade carrier 2 to move backward. In this way, the blade 3 gradually retracts into the chamber 11 of the housing 1. When the position control component 4 is pushed to the corresponding second blocking position 142, the position control component 4 and the blade carrier 2 can still be maintained in the contact state in the front-to-rear direction.

During the forward or backward pushing of the position control component 4 (as shown in FIGS. 16, 17), the positioning portion 42 of the position control component 4 is disposed on the slide rail 13, and the degree of extension of the blade 3 out of the housing 1 is adjusted. When the positioning portion 42 of the position control component 4 is located at the two second blocking position 142, the degree of extension of the blade 3 out of the housing 1 is fixed. At this time, the blade 3 may be used for cutting paper, leather, etc. During the cutting, the forefinger may be placed on the rubber force-application portion 18. In this way, the forefinger experiences good use feel. It is labor-saving.

That is, when the positioning portion 42 of the position control component 4 is located in the first blocking position 141 (as shown in FIG. 14), the position control component 4 does not interfere with the blade carrier 2, and pushing the safety control component 5 can drive the blade 3 to go into or out of the front opening 12. When the position control component 4 is located at other positions (that is, when the positioning portion 42 is disengaged from the first blocking position 141 and does not yet slide along the slide rail 13, as shown in FIG. 15; or, when the positioning portion 42 is located within each second blocking position 142, for example, as shown in FIG. 16; or, when the positioning portion 42 is located in areas on the slide rail 13 between the first blocking position 141 and the most front second blocking position 142, for example, as shown in FIG. 17), the position control component 4 can be blocking with the blade carrier 2, and sliding the position control component 4 forward and backward ca correspondingly drive the safety control component 5 and the blade carrier 2 to synchronously slide forward and backward. At this time, the safety control component 5 cannot independently slide forward and backward, and the safety control component 5 cannot independently drive the blade carrier 2 to slide forward and backward.

(3) When it is required to replace the blade 3, driven by the position control component 4, the blade carrier 2 moves forward until it completely extends out of the housing. At this time, the blade replacement switch 400 exactly corresponds to the second flange 302 of the lock plate 300. By pressing the blade replacement switch 400 down, the blade replacement switch 400 is resisted against the second flange 302 so that the second flange 302 is pushed inward and the first flange 301 is driven to be disengaged from the bayonet 31 of the blade 3. Then, the blade 3 can be taken down from the blade carrier 2 by pulling the blade 3 outward.

The locking block 101 is pushed. Under the action of the fourth elastic component 200, a part of the mount 700 is popped up from the top opening 19. The spare blade 600 is taken down from the mount 700. The mount 700 is then operated to return to the state where it is located in the chamber 11. The locking block 101 is located in the neck 701 to lock the mount 700.

The blade replacement switch 400 is continuously pressed inward. Then, the spare blade 600 is placed on the blade carrier 2 from the front opening 12. Then, the blade replacement switch 400 is released. At this time, the first flange 301 is snapped into the bayonet 31 again so that the spare blade 600 is positioned on the blade carrier 2.

(4) When the band needs to be cut, the band is placed on the blade edge at the cutting opening 17 and is then moved from side to side.

The invention claimed is:

1. A utility knife, comprising:

a housing, having a chamber, a front opening communicated with the chamber;

a blade carrier, movably disposed inside the chamber;

a blade, removably attached to the blade carrier, capable of passing through the front opening when the blade carrier slides toward the front opening;

a position control component;

a safety control component, connected to the blade carrier to push the blade carrier in and out of the front opening;

wherein, a slide rail is disposed in the chamber for the position control component to slide, the slide rail has a plurality of blocking positions which comprises a first blocking position and at least one second blocking position disposed on the slide rail at intervals along a sliding direction of the position control component;

the position control component has a positioning portion matching to the first blocking position and the second blocking position, when the position control component slides along the slide rail forward and backward relative to the housing, the positioning portion positions in different blocking positions and accordingly the blade extends out of the front opening;

a positioning direction is defined at an angle to the sliding direction of the position control component;

when the positioning portion of the position control component is located in the first blocking position, the position control component does not block the blade carrier and the blade carrier can move forward when pushed by the safety control component;

when the positioning portion of the position control component is located at a position outside the first blocking position, the position control component blocks the blade carrier from moving and the blade carrier can move forward only under control of the position control component; and wherein the first blocking position is a first recess formed on the slide rail for receiving the positioning portion, and the second blocking position is a second recess formed on the slide rail for receiving the positioning portion, the depth of the first recess is greater than the depth of the second recess, and the positioning portion is a positioning protrusion.

2. The utility knife of claim 1, wherein the forward direction of the movement of the blade carrier is defined as an advancing direction, a blocking direction is defined as transversal to the advancing direction;

the blade carrier has a first limiting portion and a second limiting portion, the first limiting portion extends in the blocking direction, and the second limiting portion is disposed on the rear side of the first limiting portion and extends in the blocking direction;

the position control component has a transmission portion, and the positioning portion is disposed on the rear side, relative to the advancing direction, of the first limiting portion and on the front side of the second limiting portion;

when the positioning portion of the position control component is at the first blocking position, the transmission portion does not interfere with the first limiting portion, the positioning portion and the second limiting portion do not overlap in the advancing direction, the blade carrier is capable of being driven to slide forward and backward by sliding the safety control component to drive the blade to extend into and out of the front opening;

when the positioning portion of the position control component is at a position outside the first blocking position, the transmission portion and the first limiting portion at least partially overlap in the advancing direction, the positioning portion and the second limiting portion at least partially overlap in the advancing direction, sliding the position control component forward enables the transmission portion of the position control component to be in blocking with the first limiting portion thus to drive the blade carrier to move forward and prevent it from returning backward.

3. The utility knife of claim 2, wherein when the positioning portion of the position control component is at the first blocking position, the positioning portion and the second limiting portion are close to each other in the blocking direction, with a small distance between them.

4. The utility knife of claim 2, wherein when the positioning portion is located at the first blocking position, the transmission portion and the first limiting portion partially overlap each other; at this time, the distance between the transmission portion and the first limiting portion in the advancing direction of the blade carrier becomes smaller;

and/or, when the positioning portion and the second limiting portion at least partially overlap in the advancing direction, the positioning portion and the second limiting portion are close to each other in the advancing direction of the blade carrier and the distance between the positioning portion and the second limiting portion becomes smaller;

and/or, a limiting groove is disposed on the back of the blade carrier, a limiting column and a spring sleeved on the limiting column are disposed between the limiting groove and an inner wall of the housing, the head of the limiting column is in fit with the limiting groove, one end of the spring is resisted against the limiting column and the other end of the spring is resisted against the inner wall of the housing, the spring has a tendency to support the limiting column, so that the head of the limiting column snaps into the limiting groove.

5. The utility knife of claim 2, wherein at least one of the transmission portion and the first limiting portion is a first plane at a position where the two resist against each other;

and/or, at least one of the positioning portion and the second limiting portion is a second plane at a position where the two resist against each other.

6. The utility knife of claim 2, wherein further comprises a sliding component and a first elastic component;

the sliding component is slidably disposed in the chamber of the housing and is used for supporting the position control component;

the first elastic component extends in the blocking direction and is used for supporting the position control component, so that the position control component moves away from the blade carrier and the positioning portion has a tendency to not interfere with the second limiting portion; one end of the first elastic component is resisted against the sliding component and the other end thereof is resisted against the position control component.

7. The utility knife of claim 6, wherein the first elastic component is a first spring or a first elastic strip; one end of the first spring or the first elastic strip is resisted against the sliding component and the other end thereof is resisted against the position control component.

8. The utility knife of claim 6, wherein the sliding component is a sliding block or a sliding plate.

9. The utility knife of claim 6, wherein the utility knife further comprises a second elastic component, which enables the blade carrier to slide backward to have a tendency to get close to the position control component backward; the second elastic component extends along the sliding direction of the blade carrier; one end of the second elastic component is connected to the blade carrier, and the other end thereof is connected to the sliding component or the inner wall of the housing;

by sliding the position control component backward, the positioning portion thereof is capable of being blocking with the second limiting portion backward, or/and the first limiting portion is capable of being blocking with the transmission portion backward, or/and the second elastic component is capable of being allowed to act on the blade carrier backward to drive the blade carrier to move backward.

10. The utility knife of claim 9, wherein the second elastic component is a tension spring or a rubber ring; one end of the tension spring or the rubber ring is connected to the blade carrier, and the other end thereof is connected to the sliding component or the inner wall of the housing.

11. The utility knife of claim 1, wherein the housing has a first chute communicated with the chamber and disposed on a side surface of the housing; the head of the position control component is disposed in the first chute, and the first chute is used for guiding the sliding of the position control component; the slide rail is located on an the inner wall of the housing corresponding to the first chute.

12. The utility knife of claim 11, wherein the housing has a second chute communicated with the chamber and disposed on a top surface of the housing; the head of the safety control component is disposed in the second chute, and the second chute is used for guiding the sliding of the safety control component; the extension length of the second chute corresponds to the extension length of the first chute.

* * * * *